US012669257B2

(12) United States Patent
Hirosaki et al.

(10) Patent No.: US 12,669,257 B2
(45) Date of Patent: Jun. 30, 2026

(54) AIR CONDITIONER

(71) Applicant: FUJITSU GENERAL LIMITED, Kanagawa (JP)

(72) Inventors: Yu Hirosaki, Kanagawa (JP); Shohei Nakata, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 139 days.

(21) Appl. No.: 18/848,524

(22) PCT Filed: Mar. 27, 2023

(86) PCT No.: PCT/JP2023/012129
§ 371 (c)(1),
(2) Date: Sep. 19, 2024

(87) PCT Pub. No.: WO2023/190302
PCT Pub. Date: Oct. 5, 2023

(65) Prior Publication Data

US 2025/0198644 A1 Jun. 19, 2025

(30) Foreign Application Priority Data

Mar. 29, 2022 (JP) ..... 2022-054456

(51) Int. Cl.
*F24F 11/87* (2018.01)
*F24F 11/86* (2018.01)
(Continued)

(52) U.S. Cl.
CPC ..... *F24F 11/86* (2018.01); *F24F 11/87* (2018.01); *F24F 11/875* (2018.01); *F24F 11/871* (2018.01)

(58) Field of Classification Search
CPC ..... F24F 11/861; F24F 11/87; F24F 11/871; F24F 11/875
(Continued)

(56) References Cited

U.S. PATENT DOCUMENTS 10,539,335 B2 1/2020 Yasuo et al.
10,563,872 B2 2/2020 Yasuo et al.

FOREIGN PATENT DOCUMENTS

CN 104736951 A 6/2015
EP 2428753 A2 3/2012
(Continued)

OTHER PUBLICATIONS

Mar. 18, 2026, European Search Report issued for related EP Application No. 23780312.7.

*Primary Examiner* — Nael N Babaa
(74) *Attorney, Agent, or Firm* — Paratus Law Group, PLLC

(57) ABSTRACT

An air conditioner includes an outdoor machine that includes a compressor and an outdoor heat exchanger, an indoor machine that includes an indoor heat exchanger and that heats inside of a room using heat supplied from the outdoor machine, an indoor temperature sensor that detects temperature inside the room, a heat accumulation circuit that includes a heat accumulating unit and that accumulates heat, which is generated in the outdoor machine, in the heat accumulating unit, and a control unit, wherein the control unit controls the compressor in such a way that detection value obtained by the indoor temperature sensor becomes equal to the set temperature, and, when the compressor operates at minimum rotation frequency and when detection value obtained by the indoor temperature sensor exceeds the set temperature, operates the heat accumulation circuit.

6 Claims, 4 Drawing Sheets

(51) Int. Cl.
*F24F 11/875* (2018.01)
*F24F 11/871* (2018.01)

(58) Field of Classification Search
USPC ..... 62/228.1
See application file for complete search history.

(56) References Cited

FOREIGN PATENT DOCUMENTS

| | | | |
|---|---|---|---|
| EP | 2860474 | A1 | 4/2015 |
| JP | H04-194539 | A | 7/1992 |
| JP | 2016-125808 | A | 7/2016 |
| JP | 2019-045106 | A | 3/2019 |
| JP | 2021-055931 | A | 4/2021 |

AIR CONDITIONER

CROSS REFERENCE TO PRIOR APPLICATION

This application is a National Stage Patent Application of PCT International Patent Application No. PCT/JP2023/012129 (filed on Mar. 27, 2023) under 35 U.S.C. § 371, which claims priority to Japanese Patent Application No. 2022-054456 (filed on Mar. 29, 2022), which are all hereby incorporated by reference in their entirety.

FIELD

The technology disclosed herein relates to an air conditioner.

BACKGROUND

A regenerative air conditioner is known in which a heat accumulation tank is provided in a refrigerant circuit and in which, in the case in which the compressor rotation frequency drops to a low rotation frequency having poor operating efficiency as a result of lowering the air-conditioning capacity needed during the heating operation, the compressor rotation frequency is increased and the heat of the refrigerant that becomes surplus as a result of increasing the compressor rotation frequency (i.e., the surplus heat) is accumulated in the heat accumulation tank (refer to Patent Literature 1). Such a regenerative air conditioner makes use of the heat that is accumulated during, for example, the defrosting operation in which the outdoor heat exchanger is heated. Thus, the electric power that is consumed as a result of increasing the compressor rotation frequency with the aim of improving the operating efficiency of the compressor is converted into heat for accumulation purposes, and then the accumulated heat is used during the defrosting operation. That enables cutting down on unnecessary power consumption and enhancing the energy saving performance.

CITATION LIST

Patent Literature

[Patent Literature 1] Japanese Laid-open Patent Publication No. 2016-125808

SUMMARY

Technical Problem

However, in such a regenerative air conditioner, at the time of accumulating the surplus heat of the refrigerant, the compression rotation frequency remains high and the situation becomes conducive to frost formation due to the cooling of the outdoor heat exchanger. For that reason, sometimes there is an increase in the duration or the frequency of the defrosting operation, thereby leading to longer periods of time for which the heating operation is stopped. That causes a decline in the comfort level of the user. Hence, conventionally, it is difficult to achieve a balance between improving the energy saving performance and holding down a decline in the comfort level.

The technology disclosed herein has been developed in view of the issues explained above, and it is an objective to provide an air conditioner that is capable of holding down a decline in the comfort level while improving the energy saving performance.

Solution to Problem

According to an aspect of an embodiment, an air conditioner includes an outdoor machine that includes a compressor and an outdoor heat exchanger, an indoor machine that includes an indoor heat exchanger and that heats inside of a room using heat supplied from the outdoor machine, an indoor temperature sensor that detects temperature inside the room, a heat accumulation circuit that includes a heat accumulating unit and that accumulates heat, which is generated in the outdoor machine, in the heat accumulating unit, and a control unit, wherein the control unit controls the compressor in such a way that detection value obtained by the indoor temperature sensor becomes equal to set temperature, and, when the compressor operates at minimum rotation frequency and when detection value obtained by the indoor temperature sensor exceeds the set temperature, operates the heat accumulation circuit.

Advantageous Effects of Invention

The air conditioner disclosed herein is capable of holding down a decline in the comfort level while improving the energy saving performance.

DESCRIPTION OF EMBODIMENTS

Figure 1:
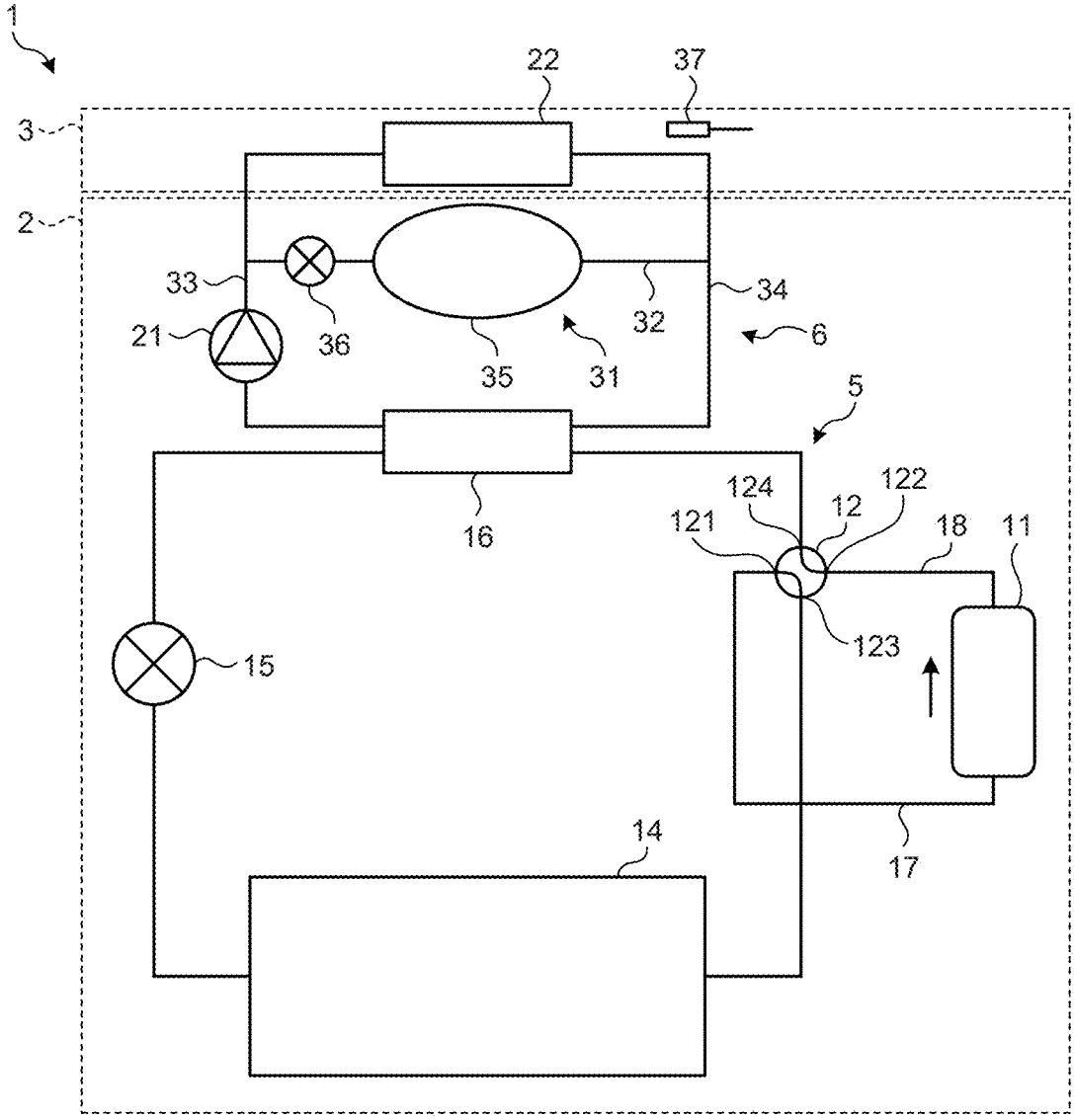
FIG. 1 is a circuit diagram illustrating an air conditioner according to a first embodiment.

Exemplary embodiments of an air conditioner according to the application concerned are described below in detail. However, the technology disclosed herein is not limited by the embodiments described below. In the following explanation, identical constituent elements are referred to by the same reference numerals, and their explanation is not given repeatedly.

First Embodiment

FIG. 1 is a circuit diagram illustrating an air conditioner 1 according to a first embodiment. The air conditioner 1 includes an outdoor machine 2 and an indoor machine 3. The outdoor machine 2 is installed out of doors. The indoor machine 3 is installed inside a room that is to be cooled or heated using the air conditioner 1. The air conditioner 1 further includes a refrigerant circuit 5 and a water circuit 6. The refrigerant circuit 5 has a flow path formed therein for the purpose of circulating a refrigerant. The water circuit 6 has a flow path formed therein for the purpose of circulating a heating medium (in the following explanation, water) serving as another refrigerant. Alternatively, the heating medium circulated in the water circuit 6 can be an antifreeze liquid. The refrigerant circuit 5 is disposed inside the outdoor machine 2. The refrigerant circuit 5 includes a compressor 11, a four-way valve 12, an outdoor heat exchanger 14, an expansion valve 15, and an intermediate heat exchanger 16.

The compressor 11 includes a suction pipe 17 and a discharge pipe 18. According to the compressor rotation frequency thereof, the compressor 11 compresses a low-pressure gas-phase refrigerant, which is supplied through the suction pipe 17, and discharges a high-pressure gas-phase refrigerant, which is generated as a result of compressing the low-pressure gas-phase refrigerant, through the discharge pipe 18.

The four-way valve 12 includes a first connecting port 121, a second connecting port 122, a third connecting port 123, and a fourth connecting port 124. The first connecting port 121 is connected to the compressor 11 via the suction pipe 17. The second connecting port 122 is connected to the compressor 11 via the discharge pipe 18. The third connecting port 123 is connected to the outdoor heat exchanger 14. The fourth connecting port 124 is connected to the intermediate heat exchanger 16. The four-way valve 12 is switchable to one of the two modes, namely, a cooling mode and a heating mode. When the four-way valve 12 is switched to the heating mode, the second connecting port 122 is connected to the fourth connecting port 124, and the third connecting port 123 is connected to the first connecting port 121. When the four-way valve 12 is switched to the cooling mode, the second connecting port 122 is connected to the third connecting port 123, and the fourth connecting port 124 is connected to the first connecting port 121.

The outdoor heat exchanger 14 is connected to the expansion valve 15. The intermediate heat exchanger 16 is also connected to the expansion valve 15.

The water circuit 6 includes a pump 21 and an indoor heat exchanger 22. The pump 21 is disposed inside the outdoor machine 2. Moreover, the pump 21 is connected to the intermediate heat exchanger 16 and the indoor heat exchanger 22. The pump 21 supplies the water, which is supplied thereto from the intermediate heat exchanger 16, to the indoor heat exchanger 22, and thus circulates the water in the water circuit 6. The indoor heat exchanger 22 is disposed inside the indoor machine 3. Moreover, the indoor heat exchanger 22 is connected to the intermediate heat exchanger 16.

The air conditioner 1 further includes a heat accumulation circuit 31 that is disposed inside the outdoor machine 2. In the heat accumulation circuit 31, a heat accumulation flow path 32 is formed. Via the heat accumulation flow path 32, a first flow path 33 that is formed between the pump 21 and the indoor heat exchanger 22 of the water circuit 6 is connected to a second flow path 34 that is formed between the indoor heat exchanger 22 and the intermediate heat exchanger 16 of the water circuit 6. The heat accumulation circuit 31 includes a heat accumulating unit 35 and a heat accumulation circuit valve 36. The heat accumulating unit 35 is made of a material having a higher degree of specific heat as compared to the water. The heat accumulating unit 35 is used to store the water flowing through the heat accumulation flow path 32. The heat accumulation circuit valve 36 is opened in order to ensure that the first flow path 33 and the second flow path 34 are connected, and is closed in order to ensure that the first flow path 33 and the second flow path 34 are not connected.

Figure 2:
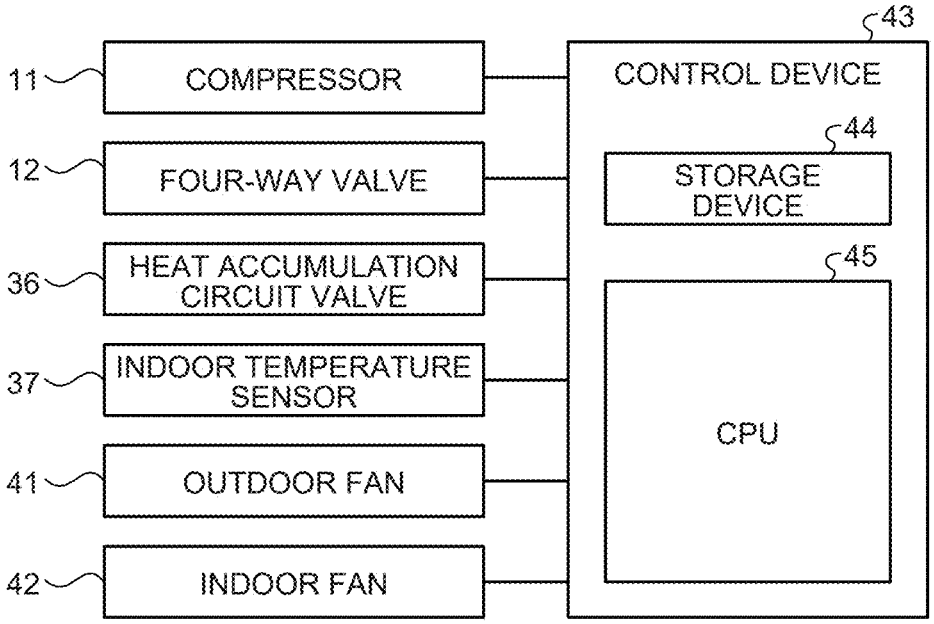
FIG. 2 is a block diagram illustrating the air conditioner according to the first embodiment.

FIG. 2 is a block diagram illustrating the air conditioner 1 according to the first embodiment. The air conditioner 1 includes an outdoor fan 41, an indoor fan 42, and a control device 43. The outdoor fan 41 is disposed inside the outdoor machine 2. The outdoor fan 41 is controlled by the control device 43 and blows the outside air so as to cause heat exchange between the outdoor heat exchanger 14 and the outside air. The indoor fan 42 is disposed inside the indoor machine 3. The indoor fan 42 is controlled by the control device 43 and blows the indoor air so as to cause heat exchange between the indoor heat exchanger 22 and the indoor air and to ensure that the indoor air having been subjected to heat exchange with the indoor heat exchanger 22 blows out from the indoor machine 3 into the room.

The control device 43 is a computer that includes a storage device 44 and a CPU 45 (Central Processing Unit). The storage device 44 is used to store computer programs to be installed in the control device 43, and to store the information to be used by the CPU 45. The CPU 45 executes the computer programs installed in the control device 43, and accordingly performs information processing and controls the storage device 44.

The control device 43 controls the compressor 11, the four-way valve 12, the heat accumulation circuit valve 36, the outdoor fan 41, and the indoor fan 42. The storage device 44 is used to store the minimum rotation frequency, the rotation frequency threshold value, and the threshold time period. The minimum rotation frequency represents a value specific to the compressor 11; and the compressor 11 is not capable of operating at a compressor rotation frequency lower than the minimum rotation frequency. The rotation frequency threshold value represents a value specific to the compressor 11 and indicates the minimum rotation frequency for the range in which the operating efficiency of the compressor 11 is equal to or greater than 80%. That is, when the compressor 11 compresses the low-pressure gas-phase refrigerant at a rotation frequency lower than the rotation frequency threshold value, the efficiency is lower than the efficiency at the time when the compressor 11 compresses the low-pressure gas-phase refrigerant at the rotation frequency equal to the rotation frequency threshold value. Meanwhile, the rotation frequency threshold value is greater than the minimum rotation frequency. Moreover, the indoor machine 3 includes an indoor temperature sensor 37 for detecting the indoor temperature.

The operations performed by the air conditioner 1 include a cooling operation, a heating operation, a heat accumulation operation, and a defrosting operation.

Cooling Operation

The cooling operation is performed when, for example, the air conditioner 1 is operated by a user. When the cooling operation is performed in the air conditioner 1, the control device 43 controls the four-way valve 12 and switches the mode thereof to the cooling mode. Then, based on the temperature difference between the set temperature, which is set by the user, and the indoor temperature detected by the indoor temperature sensor 37, the control device 43 calculates the rotation frequency of the compressor 11 and controls the compressor 11 to operate at the calculated rotation frequency; so that the low-pressure gas-phase refrigerant supplied via the suction pipe 17 is compressed. When compressed by the compressor 11, the low-pressure gas-phase refrigerant changes the state to the high-pressure gas-phase refrigerant. Then, the compressor 11 discharges the high-pressure gas-phase refrigerant to the discharge pipe 18. Since the four-way valve 12 is switched to the cooling mode, the high-pressure gas-phase refrigerant discharged from the discharge pipe 18 is supplied to the outdoor heat exchanger 14.

The control device 43 controls the outdoor fan 41 that blows the outside air so as to cause heat exchange of, the outside air with the outdoor heat exchanger 14. The outdoor heat exchanger 14 causes heat exchange between the high-pressure gas-phase refrigerant, which is supplied from the four-way valve 12, and the outside air; so that the high-pressure gas-phase refrigerant is cooled and the outside air is heated. When cooled, the high-pressure gas-phase refrigerant changes the state to the supercooled high-pressure gas-phase refrigerant. That is, when the cooling operation is performed in the air conditioner 1, the outdoor heat exchanger 14 functions as a condensing appliance. The high-pressure gas-phase refrigerant that flows out of the outdoor heat exchanger 14 is supplied to the expansion valve 15.

The expansion valve 15 adjusts the flow rate of the refrigerant flowing out from the outdoor heat exchanger 14 to the intermediate heat exchanger 16, and reduces the pressure of the high-pressure gas-phase refrigerant that is supplied from the outdoor heat exchanger 14. As a result of pressure reduction, the high-pressure gas-phase refrigerant changes the state to the low-pressure gas-liquid two-phase refrigerant having a high degree of humidity wetness. The low-pressure gas-liquid two-phase refrigerant flowing out from the expansion valve 15 is then supplied to the intermediate heat exchanger 16.

During the cooling operation, the intermediate heat exchanger 16 causes heat exchange between the low-pressure gas-liquid two-phase refrigerant, which flows out from the expansion valve 15, and the water circulating through the water circuit 6; so that the water is cooled and the low-pressure gas-liquid two-phase refrigerant is heated. When heated by the intermediate heat exchanger 16, the low-pressure gas-liquid two-phase refrigerant changes the state to the low-pressure gas-phase refrigerant. That is, when the cooling operation is performed in the air conditioner 1, the intermediate heat exchanger 16 functions as an evaporator. The low-pressure gas-phase refrigerant that flows out from the intermediate heat exchanger 16 is then supplied to the four-way valve 12. Since the four-way valve 12 is switched to the cooling mode, the low-pressure gas-phase refrigerant supplied thereto is further supplied to the compressor 11 via the suction pipe 17.

When the cooling operation is performed in the air conditioner 1, the control device 43 controls the heat accumulation circuit valve 36 and blocks the heat accumulation flow path 32 in such a way that the water does not flow through the heat accumulation flow path 32. That is done to prevent a situation in which the heat accumulation circuit valve 36 is opened and the water stored in the heat accumulating unit 35 circulates through the water circuit 6. If the water stored in the heat accumulating unit 35 circulates through the water circuit 6, then the heat capacity of the water circuit 6 increases and hence the temperature of the water that is allowed to flow into the indoor heat exchanger 22 does not easily drop. Since the pump 21 circulates the water in the water circuit 6, the water cooled by the intermediate heat exchanger 16 is supplied to the indoor heat exchanger 22. Then, the indoor heat exchanger 22 causes heat exchange between the water supplied from the pump 21 and the indoor air in the room in which the indoor machine 3 is installed; so that the water is heated and the indoor air is cooled. The heated water circulates through the water circuit 6 and is supplied to the intermediate heat exchanger 16. The control device 43 controls the indoor fan 42 that blows the indoor air so as to cause heat exchange of the indoor air with the indoor heat exchanger 22 and that the indoor air cooled by the indoor heat exchanger 22 is blown out into the room. That is, in the indoor machine 3, the indoor heat exchanger 22 cools the indoor air, so that the room becomes cool.

Heating Operation

The heating operation is performed when, for example, the air conditioner 1 is operated by a user. When the heating operation is performed in the air conditioner 1, the control device 43 switches the four-way valve 12 to the heating mode. Then, based on the set temperature, which is set by the user, and the indoor temperature, the control device 43 calculates the rotation frequency of the compressor 11 and controls the compressor 11 to operate at the calculated rotation frequency; so that the low-pressure gas-phase refrigerant supplied via the suction pipe 17 is compressed. When compressed by the compressor 11, the low-pressure gas-phase refrigerant changes the state to the high-pressure gas-phase refrigerant. Then, the compressor 11 discharges the high-pressure gas-phase refrigerant to the discharge pipe 18. Since the four-way valve 12 is switched to the heating mode, the high-pressure gas-phase refrigerant discharged from the discharge pipe 18 is supplied to the intermediate heat exchanger 16.

During the heating operation, the intermediate heat exchanger 16 causes heat exchange between the high-pressure gas-phase refrigerant, which flows out from the four-way valve 12, and the water circulating through the water circuit 6; so that the water is heated and the high-pressure gas-phase refrigerant is cooled. When cooled by the intermediate heat exchanger 16, the high-pressure gas-phase refrigerant changes the state to the supercooled high-pressure gas-phase refrigerant. That is, when the heating operation is performed in the air conditioner 1, the intermediate heat exchanger 16 functions as a condensing appliance. The high-pressure gas-phase refrigerant that flows out of the intermediate heat exchanger 16 is supplied to the expansion valve 15.

The expansion valve 15 adjusts the flow rate of the refrigerant flowing out from the intermediate heat exchanger 16 to the outdoor heat exchanger 14, and reduces the pressure of the high-pressure gas-phase refrigerant that is supplied from the intermediate heat exchanger 16. As a result of pressure reduction, the high-pressure gas-phase refrigerant changes the state to the low-pressure gas-liquid two-phase refrigerant having a high degree of humidity wetness. The low-pressure gas-liquid two-phase refrigerant flowing out from the expansion valve 15 is supplied to the outdoor heat exchanger 14.

The control device 43 controls the outdoor fan 41 that blows the outside air so as to cause heat exchange of the outside air with the outdoor heat exchanger 14. The outdoor heat exchanger 14 causes heat exchange between the low-pressure gas-liquid two-phase refrigerant, which is supplied from the expansion valve 15, and the outside air; so that the low-pressure gas-liquid two-phase refrigerant is heated and the outside air is cooled. When heated, the low-pressure gas-liquid two-phase refrigerant changes the state to the low-pressure gas-phase refrigerant having a low degree of humidity wetness. That is, when the heating operation is performed in the air conditioner 1, the outdoor heat exchanger 14 functions as a condensing appliance. The low-pressure gas-phase refrigerant that flows out from the outdoor heat exchanger 14 is supplied to the four-way valve 12. Since the four-way valve 12 is switched to the heating mode, the low-pressure gas-phase refrigerant that flows out from the outdoor heat exchanger 14 is supplied to the suction pipe 17, and is then supplied to the compressor 11 via the suction pipe 17.

When the heating operation is performed in the air conditioner 1, the control device 43 controls the heat accumulation circuit valve 36 and blocks the heat accumulation flow path 32 in such a way that the water does not flow through the heat accumulation flow path 32. That is done to prevent a situation in which the heat accumulation circuit valve 36 is opened and the water stored in the heat accumulating unit 35 circulates through the water circuit 6. If the water stored in the heat accumulating unit 35 circulates through the water circuit 6, then the heat capacity of the water circuit 6 increases and hence the temperature of the water that is allowed to flow into the indoor heat exchanger 22 does not easily rise. Since the pump 21 circulates the water in the water circuit 6, the water that is heated by the intermediate heat exchanger 16 is supplied to the indoor heat exchanger 22. When heat exchange occurs between the water supplied from the pump 21 and the indoor air in the room inside which the indoor machine 3 is installed, the indoor heat exchanger 22 cools the water and heats the indoor air. Then, the heated water circulates through the water circuit 6 and is supplied to the intermediate heat exchanger 16. The control device 43 controls the indoor fan 42 that blows the indoor air so as to cause heat exchange of the indoor air with the indoor heat exchanger 22 and to ensure that the air heated by the indoor heat exchanger 22 is blown into the room. That is, in the indoor machine 3, the indoor air is heated by the heat supplied from the outdoor machine 2, so that the room becomes warm.

When the heating operation is performed in the air conditioner 1, since the water does not flow through the heat accumulation flow path 32, the heat accumulation circuit 31 does not accumulate the heat of the water in the heat accumulating unit 35. In the air conditioner 1, since the heat accumulation circuit 31 does not accumulate heat, during the heating operation, there is no unnecessary power consumption for the purpose of heat accumulation, thereby enabling achieving reduction in the power consumption.

Heat Accumulation Operation

Figure 3:
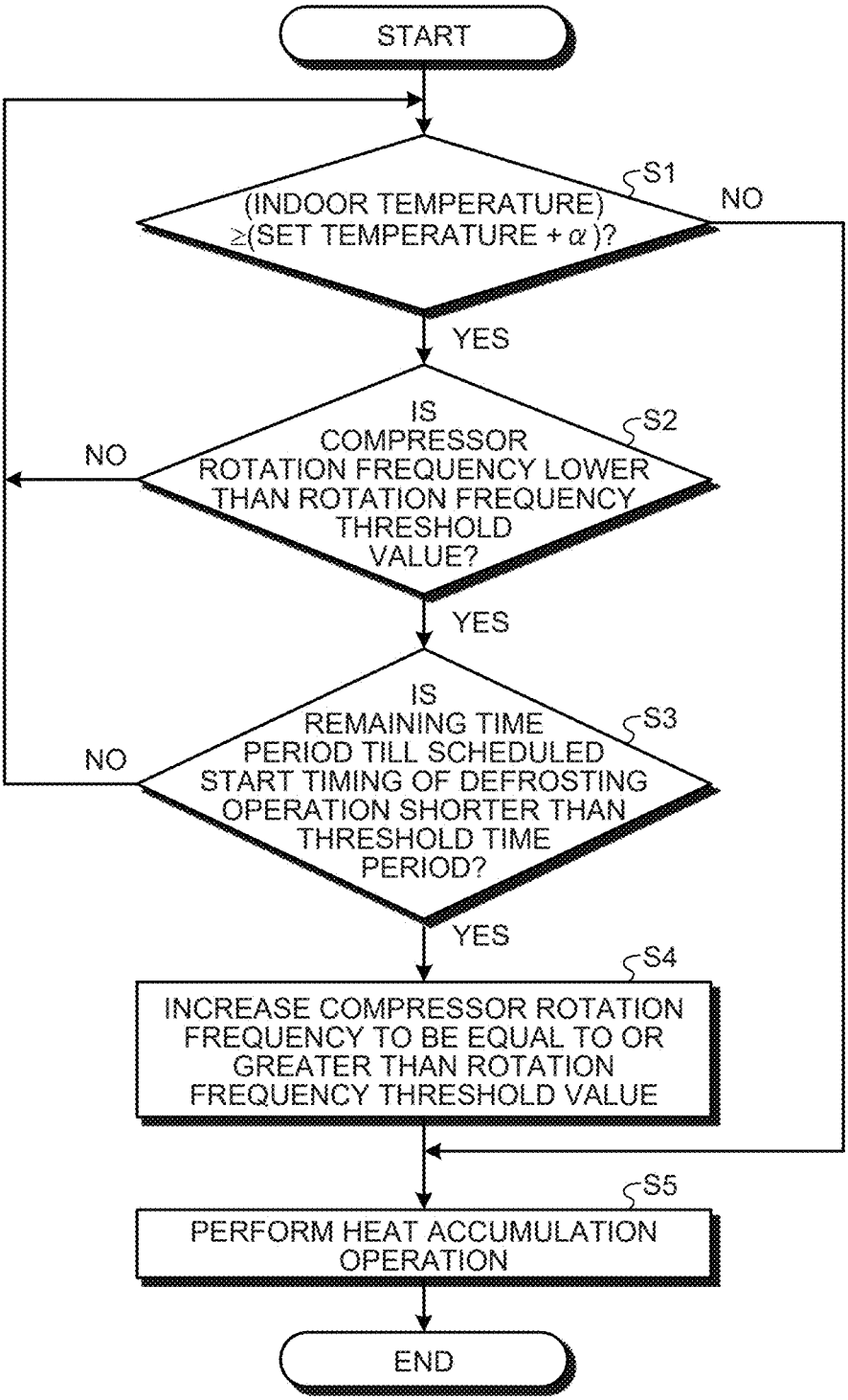
FIG. 3 is a flowchart for explaining an operation for determining whether or not a heat accumulation operation needs to be performed.

While the heating operation is underway, when the control device 43 determines that the heat accumulation operation can be performed, the heat accumulation operation is performed. FIG. 3 is a flowchart for explaining the operation for determining whether or not the heat accumulation operation can be performed. While the heating operation is underway, the storage device 44 is intermittently used to store the rotation frequency demanded from the compressor 11 (in the following explanation, referred to as the demanded rotation frequency), which is set in advance according to the temperature difference between the set temperature set by the user and the indoor temperature. The demanded rotation frequency represents the increase-decrease value of the rotation frequency demanded from the compressor 11 and set in advance according to the temperature difference. Thus, the demanded rotation frequency increases in proportion to the temperature difference. The control device 43 determines whether or not the indoor temperature detected by the indoor temperature sensor 37 is equal to or lower than the set temperature. More particularly, the control device 43 determines whether or not the indoor temperature detected by the indoor temperature sensor 37 is lower than (the set temperature+$\alpha$° C.) (i.e., lower than a positive value such as 0.5° C.) (Step S1). Herein, as compared to the thermo-off condition (for example, 1.5° C.) at which the compressor 11 stops operating, a is set to a smaller value (for example, an arbitrary value equal to or greater than 0.1° C. and lower than 1.5° C.). The thermo-off condition implies that the heating operation is stopped until the indoor temperature again drops below the set temperature.

If the indoor temperature is lower than the (the set temperature+$\alpha$° C.) (Yes at Step S1), then the control device 43 maintains the control of the compressor 11 for compressing the low-pressure gas-phase refrigerant according to the demanded rotation frequency. When the indoor temperature is lower than (the set temperature+$\alpha$° C.), the control device 43 determines whether or not the rotation frequency of the compressor 11 is lower than the rotation frequency threshold value recorded in the storage device 44 (Step S2). If the rotation frequency of the compressor 11 is equal to or greater than the rotation frequency threshold value (No at Step S2), then the operations at Steps S1 and S2 are performed in a repeated manner. The rotation frequency threshold value represents a value specific to the compressor 11 and indicates the minimum rotation frequency for the range in which the operating efficiency of the compressor 11 is equal to or greater than 80%. That is, when the compressor 11 compresses the low-pressure gas-phase refrigerant at a rotation frequency lower than the rotation frequency threshold value, the efficiency is lower than the efficiency at the time when the compressor 11 compresses the low-pressure gas-phase refrigerant at the rotation frequency equal to the rotation frequency threshold value. Meanwhile, the rotation frequency threshold value is greater than the minimum rotation frequency. Moreover, the indoor machine 3 includes the indoor temperature sensor 37 for detecting the indoor temperature.

Meanwhile, if the rotation frequency of the compressor 11 is lower than the rotation frequency threshold value (Yes at Step S2), then the control device 43 determines whether or not the remaining time period till the scheduled start timing of the defrosting operation is shorter than a threshold time period (for example, five minutes) that is recorded in the storage device 44 (Step S3). The scheduled start timing of the defrosting operation indicates the timing arriving after the elapse of a predetermined period of time since the timing at which the heating operation was started under a predetermined condition. If the remaining time period is equal to or longer than the threshold time period (No at Step S3), then the control device 43 controls the compressor 11 to ensure that the low-pressure gas-phase refrigerant is compressed according to the demanded rotation frequency, and performs the operations from Step S1 to Step S3 in a repeated manner. Meanwhile, if the rotation frequency of the compressor 11 is lower than the rotation frequency threshold value (Yes at Step S2) and if the remaining time period is shorter than the threshold time period (Yes at Step S3), then the control device 43 controls the compressor 11 and increases the rotation frequency of the compressor 11 to be equal to or greater than the rotation frequency threshold value (Step S4).

Either after increasing the rotation frequency of the compressor 11 or when the indoor temperature is equal to or higher than (the set temperature+$\alpha$° C.) (No at Step S1), the control device 43 performs the heat accumulation operation in which the heat accumulation circuit 31 is operated (Step S5). That is, the control device 43 controls the heat accumulation circuit valve 36 and opens it to enable the flow of the water through the heat accumulation flow path 32. As a result of increasing the rotation frequency of the compressor 11, the amount of heat supplied to the indoor heat exchanger 22 becomes excessive with respect to the amount of heat needed for heating. Hence, the surplus heat is accumulated in the heat accumulation circuit 31. As a result of opening the heat accumulation circuit valve 36, the heat accumulation circuit 31 causes heat exchange of the water, which is supplied from the pump 21, with the heat accumulating unit 35; so that the heat accumulating unit 35 is heated and the water is cooled. That is, in the air conditioner 1, during the heat accumulation operation, the heat of the water is accumulated in the heat accumulating unit 35, and the heat of the refrigerant is accumulated in the heat accumulating unit 35 via the water.

In the air conditioner 1, until the remaining time period till starting the defrosting operation becomes shorter than the threshold time period, the heat accumulation operation is not performed. That enables holding down a situation in which performing the heat accumulation operation promotes frosting on the outdoor heat exchanger 14. Moreover, the surplus electric power is converted into heat for accumulation purposes, and then the accumulated heat is used during the defrosting operation. That enables cutting down on unnecessary power consumption and enhancing the energy saving performance. Furthermore, in the air conditioner 1, during the heat accumulation operation, the compressor 11 compresses the refrigerant at the rotation frequency equal to or greater than the rotation frequency threshold value. Hence, the heat accumulation operation can be performed in the state in which the compressor 11 is driven at such a rotation frequency which enables excellent operating efficiency. Moreover, in the air conditioner 1, since the heat accumulation operation is performed when the indoor temperature is equal to or greater than (the set temperature+$\alpha$° C.), the surplus heat can be accumulated in the heat accumulation circuit 31 and the accumulated heat can be used during the defrosting operation.

Defrosting Operation

After the heating operation is performed on a continuous basis under a predetermined condition and for a predetermined period of time or beyond, the defrosting operation is performed. In the air conditioner 1, at the time of performing the defrosting operation, the control device 43 controls the four-way valve 12 and switches the mode thereof to the cooling mode. Then, the control device 43 controls the compressor 11 so that the low-pressure gas-phase refrigerant, which is supplied via the suction pipe 17, is compressed at a predetermined rotation frequency. When compressed by the compressor 11, the low-pressure gas-phase refrigerant changes the state to the high-pressure gas-phase refrigerant. Then, the compressor 11 discharges the high-pressure gas-phase refrigerant to the discharge pipe 18. Since the four-way valve 12 is switched to the cooling mode, the high-pressure gas phase refrigerant discharged to the discharge pipe 18 is supplied to the outdoor heat exchanger 14.

The control device 43 controls the outdoor fan 41 and stops it to ensure that the outside air is not blown in. The outdoor heat exchanger 14 causes heat exchange between the high-pressure gas-phase refrigerant, which is supplied from the four-way valve 12, and the frost formed on the outdoor heat exchanger 14; so that the high-pressure gas-phase refrigerant is cooled and the frost formed on the outdoor heat exchanger 14 is heated. When cooled, the high-pressure gas-phase refrigerant changes the state to the supercooled high-pressure gas-phase refrigerant. That is, when the defrosting operation is performed in the air conditioner 1, the outdoor heat exchanger 14 functions as a condensing appliance. The heated frost melts and drops down from the outdoor heat exchanger 14. Thus, as a result of performing the defrosting operation in the air conditioner 1, the outdoor heat exchanger 14 can be defrosted. Moreover, the outdoor heat exchanger 14 supplies the high-pressure gas-phase refrigerant to the expansion valve 15.

The expansion valve 15 adjusts the flow rate of the refrigerant flowing out from the outdoor heat exchanger 14 to the intermediate heat exchanger 16, and causes expansion of the high-pressure gas-phase refrigerant that is supplied from the outdoor heat exchanger 14. As a result of expansion, the high-pressure gas-phase refrigerant changes the state to the low-pressure gas-liquid two-phase refrigerant having a high degree of humidity wetness. The low-pressure gas-liquid two-phase refrigerant flowing out from the expansion valve 15 is then supplied to the intermediate heat exchanger 16.

The intermediate heat exchanger 16 causes heat exchange between the low-pressure gas-liquid two-phase refrigerant, which is supplied from the expansion valve 15, and the water circulating through the water circuit 6; so that the water is cooled and the low-pressure gas-liquid two-phase refrigerant is heated. When heated by the intermediate heat exchanger 16, the low-pressure gas-liquid two-phase refrigerant changes the state to the low-pressure gas-phase refrigerant. That is, when the defrosting operation is performed in the air conditioner 1, the intermediate heat exchanger 16 functions as an evaporator. Then, the intermediate heat exchanger 16 supplies the low-pressure gas-phase refrigerant to the four-way valve 12. Since the four-way valve 12 is switched to the cooling mode, the low-pressure gas-phase refrigerant, which is supplied from the intermediate heat exchanger 16, is supplied to the compressor 11 via the suction pipe 17.

When the defrosting operation is performed in the air conditioner 1, the control device 43 controls the heat accumulation circuit valve 36 and opens it to enable the flow of the water through the heat accumulation flow path 32. The pump 21 supplies the water, which is supplied from the intermediate heat exchanger 16, to the indoor heat exchanger 22 and the heat accumulation circuit 31, and thus circulates the water through the water circuit 6. The indoor heat exchanger 22 causes heat exchange of the water, which is supplied from the pump 21, with the indoor heat exchanger 22; so that the water is heated and the indoor heat exchanger 22 is cooled. The control device 43 controls the indoor fan 42 and stops it to ensure that the air is not blown into the room from the indoor machine 3. When the defrosting operation is performed in the air conditioner 1, since the indoor fan 42 is stopped, the indoor air can be prevented from being cooled by the indoor heat exchanger 22, and hence a decline in the comfort level can be held down.

Since the heat accumulation circuit valve 36 is opened, the heat accumulation circuit 31 causes heat exchange of the water, which is supplied from the pump 21, with the heat accumulating unit 35; so that the heat accumulating unit 35 is cooled and the water is heated. That is, during the defrosting operation, the heat accumulation circuit 31 heats the water using the heat accumulated in the heat accumulating unit 35. The water heated by the indoor heat exchanger 22 or the heat accumulation circuit 31 is circulated in the water circuit 6 by the pump 21 and is then supplied to the intermediate heat exchanger 16.

That is, in the air conditioner 1, during the defrosting operation, the outdoor heat exchanger 14 can be heated using the heat accumulated in the heat accumulating unit 35; so that defrosting of the outdoor heat exchanger 14 can be done using the heat accumulated in the heat accumulating unit 35. In the air conditioner 1, since the outdoor heat exchanger 14 is heated using the heat accumulated in the heat accumulating unit 35, the amount of heat to be obtained from the indoor air for the purpose of heating the outdoor heat exchanger 14 can be reduced, thereby making it possible to heat the outdoor heat exchanger 14 without excessively cooling the indoor heat exchanger 22. As a result, a decline in the comfort level during the defrosting operation can be held down by ensuring that the room is not excessively cooled.

Effects Achieved in Air Conditioner 1 According to First Embodiment

The air conditioner 1 according to the first embodiment includes the compressor 11, the indoor machine 3, the control device 43, and the heat accumulation circuit 31. The compressor 11 circulates the refrigerant in the refrigerant circuit 5. The indoor machine 3 heats the inside of the room using the heat of the refrigerant that is supplied to the indoor heat exchanger 22. When the compressor 11 operates at the minimum rotation frequency and when the indoor temperature exceeds the set temperature (i.e., becomes equal to or greater than (the set temperature+$\alpha$° C.)), the heat accumulation circuit 31 heats the heat accumulating unit 35 using the heat of the refrigerant.

In the air conditioner 1 according to the first embodiment, when the compressor 11 operates at the minimum rotation frequency and when the indoor temperature exceeds the set temperature (i.e., becomes equal to or greater than (the set temperature+$\alpha$° C.)), the generated heat is accumulated in the heat accumulating unit 35; so that a decline in the comfort level can be held down by ensuring that the room is not excessively heated. In the air conditioner 1, as a result of effectively using the heat accumulated in the heat accumulating unit 35, it becomes possible to reduce the power consumption.

Moreover, in the air conditioner 1 according to the first embodiment, during the defrosting operation in which a heat exchanger meant for causing heat exchange between the outside air and the refrigerant is heated, the heat accumulation circuit 31 heats the refrigerant using the heat accumulated in the heat accumulating unit 35. In the air conditioner 1 according to the first embodiment, since the heat accumulated in the heat accumulating unit 35 is used in the defrosting operation, it becomes possible to hold down a drop in the indoor temperature during the defrosting operation.

Furthermore, in the air conditioner 1 according to the first embodiment, when the remaining time period till the start of the defrosting operation is equal to or longer than the predetermined threshold time period, the control device 43 controls the compressor 11 in such a way that the compressor rotation frequency becomes equal to the demanded rotation frequency. If the remaining time period is shorter than the threshold time period, then the control device 43 controls the compressor 11 in such a way that the compressor rotation frequency becomes higher than the present rotation frequency, and heats the heat accumulating unit 35 using the heat of the refrigerant. In the air conditioner 1 according to the first embodiment, when the remaining time period till the start of the defrosting operation is equal to or longer than the threshold time period, the compressor rotation frequency is not increased to ensure that frost formation on the outdoor heat exchanger 14 is not promoted. In the air conditioner 1 according to the first embodiment, when the remaining time period is shorter than the threshold time period, the compressor rotation frequency is increased to be higher than the present rotation frequency. As a result, while holding down an increase or a decrease in the amount of frost formation attributed to operating the compressor at a high rotation frequency for a long period of time, a large amount of heat can be accumulated before performing the defrosting operation, thereby enabling appropriate defrosting of the outdoor heat exchanger 14.

Moreover, in the air conditioner 1 according to the first embodiment, when the present rotation frequency of the compressor 11 is equal to or greater than the rotation frequency threshold value, the heat accumulation circuit 31 continues the heating operation using the heat of the refrigerant and without heating the heat accumulating unit 35. When the present rotation frequency of the compressor 11 drops below the rotation frequency threshold value, the heat accumulation circuit 31 controls the compressor 11 in such a way that the compressor rotation frequency becomes equal to or higher than the rotation frequency threshold value, and then heats the heat accumulating unit 35 using the heat of the refrigerant. When the refrigerant is compressed according to the compressor rotation frequency equal to or greater than the rotation frequency threshold value, the compressor 11 becomes able to operate with excellent operating efficiency. In the air conditioner 1 according to the first embodiment, when the rotation frequency of the compressor 11 is equal to or greater than the rotation frequency threshold value, that is, when the compressor 11 is operating with excellent operating efficiency, the compressor rotation frequency is not increased. However, when the operating efficiency is low, the compressor rotation frequency is increased to be equal to or higher than the rotation frequency threshold value, and then the heat accumulation operation is performed.

In the air conditioner 1 according to the first embodiment, the heat accumulating unit 35 accumulates heat by means of heat exchange with the water flowing through the heat accumulation flow path 32. However, the heat accumulating unit 35 can be replaced with a hot-water tank used for water storage. In the hot-water tank, the water is stored and, when the heat accumulation circuit valve 36 is opened, the stored water is replaced with the water supplied from the pump 21. That is, when the heat accumulation circuit valve 36 is opened, the heated water is stored in the hot-water tank, thereby enabling accumulation of the heat of the water. When the heat accumulation circuit valve 36 is opened, the hot water stored in the hot-water tank is supplied to the intermediate heat exchanger 16, so that the accumulated heat can be used in air heating. In the air conditioner 1, even when such a hot-water tank is used, it becomes possible to hold down a decline in the comfort level, while cutting down on power consumption and enhancing the energy saving performance in an identical manner to the air conditioner 1 according to the first embodiment.

In the air conditioner 1 according to the first embodiment, the heat accumulation circuit valve 36 is used to ensure that the water either flows or does not flow through the heat accumulation flow path 32. Alternatively, an on-off valve can be further installed. During the cooling operation, or during the heating operation, or during the heat accumulation operation; the control device 43 controls the on-off valve to ensure that the water flows through the indoor heat exchanger 22. During the defrosting operation, the control device 43 controls the on-off valve to ensure that the water does not flow through the indoor heat exchanger 22. In the air conditioner 1, even when such an on-off valve is used, it becomes possible to hold down a decline in the comfort level, while cutting down on power consumption and enhancing the energy saving performance in an identical manner to the air conditioner 1 according to the first embodiment.

Second Embodiment

Figure 4:
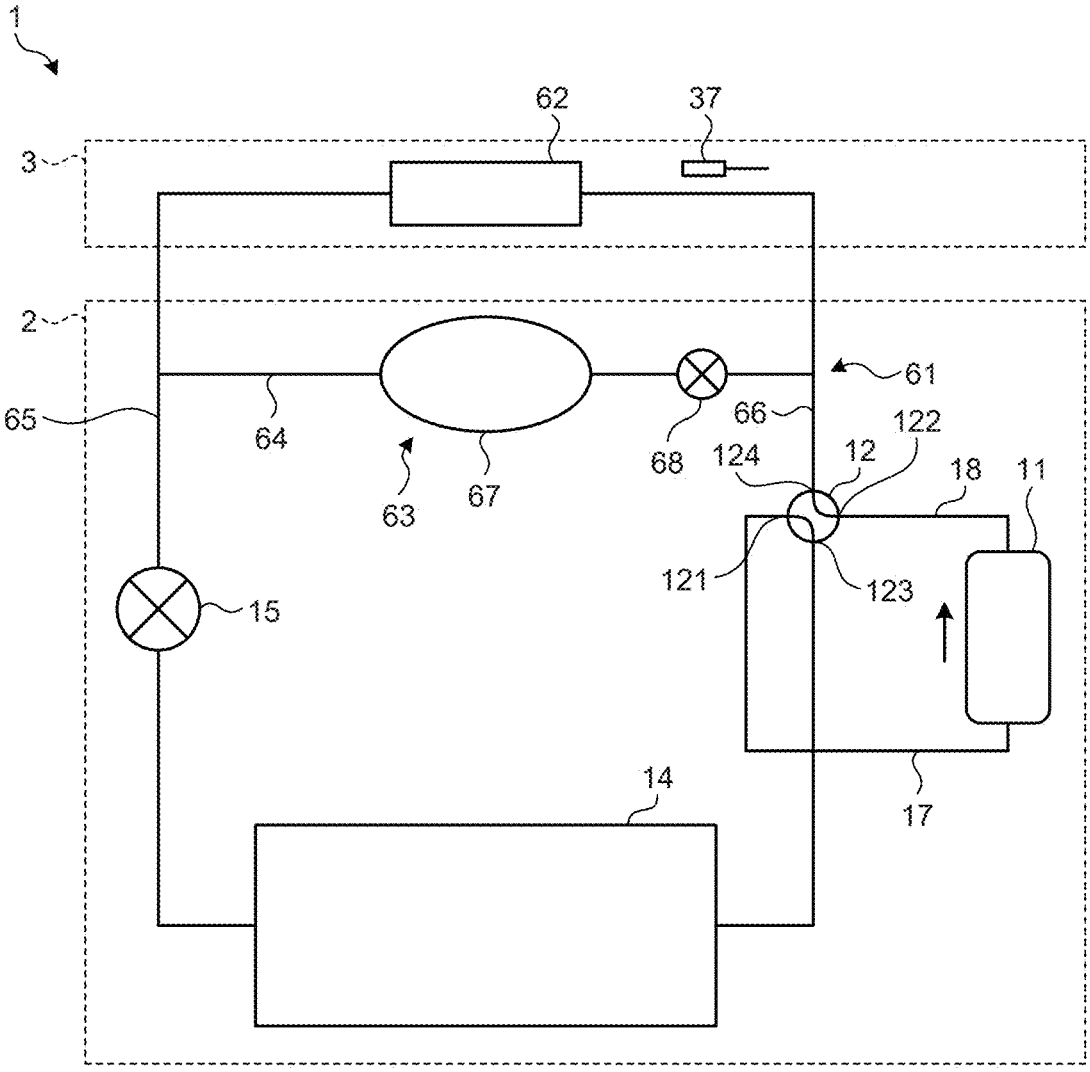
FIG. 4 is a circuit diagram illustrating an air conditioner according to a second embodiment.

FIG. 4 is a circuit diagram illustrating an air conditioner according to a second embodiment. In the air conditioner according to the second embodiment, the water circuit 6 included in the air conditioner 1 according to the first embodiment is omitted, and the refrigerant circuit 5 is replaced with another refrigerant circuit 61. In the refrigerant circuit 61, an indoor heat exchanger 62 is substituted for the intermediate heat exchanger 16 of the refrigerant circuit 5 of the air conditioner 1 according to the first embodiment. Apart from that, the refrigerant circuit 61 is same as the refrigerant circuit 5. The indoor heat exchanger 62 is disposed inside the indoor machine 3. The indoor fan 42 blows the indoor air so that heat exchange of the indoor air occurs with the indoor heat exchanger 62, and the indoor air having been subjected to heat exchange in the indoor heat exchanger 62 blows into the room from the indoor machine 3.

The air conditioner according to the second embodiment further includes a heat accumulation circuit 63 that is disposed inside the outdoor machine 2. In the heat accumulation circuit 63, a heat accumulation flow path 64 is formed. In the refrigerant circuit 61, a first flow path 65 that is formed between the expansion valve 15 and the indoor heat exchanger 62 is connected via the heat accumulation flow path 64 to a second flow path 66 that is formed between the indoor heat exchanger 62 and the four-way valve 12. The heat accumulation circuit 63 includes a heat accumulating unit 67 and a heat accumulation circuit valve 68. The heat accumulating unit 67 is made of a material having a higher degree of specific heat as compared to the water. The heat accumulating unit 67 causes heat exchange with the water flowing through the heat accumulation flow path 64. The heat accumulation circuit valve 68 is opened in order to ensure that the first flow path 65 and the second flow path 66 are connected, and is closed in order to ensure that the first flow path 65 and the second flow path 66 are not connected.

In an identical manner to the air conditioner 1 according to the first embodiment, the control device 43 controls the compressor 11, the four-way valve 12, the outdoor fan 41, and the indoor fan 42; as well as controls the heat accumulation circuit valve 68 in an identical manner to controlling the heat accumulation circuit valve 36 of the air conditioner 1 according to the first embodiment. That is, when the cooling operation or the heating operation is performed in the air conditioner, the control device 43 controls the heat accumulation circuit valve 68 and blocks the heat accumulation flow path 64 in such a way that the water does not flow through the heat accumulation flow path 32.

When the heat accumulation operation is performed in the air conditioner, the control device 43 controls the heat accumulation circuit valve 68 and opens the heat accumulation flow path 64 in such a way that the water flows through the heat accumulation flow path 32. In the air conditioner, until the remaining time period till the start of the defrosting operation becomes shorter than the threshold time period, the heat accumulation is not performed. Hence, in an identical manner to the air conditioner 1 according to the first embodiment, it becomes possible to hold down a situation in which performing the heat accumulation operation promotes frosting on the outdoor heat exchanger 14. Moreover, the surplus electric power is converted into heat for accumulation purposes, and then the accumulated heat is used during the defrosting operation. That enables cutting down on unnecessary power consumption and enhancing the energy saving performance. Furthermore, in the air conditioner, during the heat accumulation operation, the compressor 11 compresses the refrigerant at the rotation frequency equal to or greater than the rotation frequency threshold value. Hence, in an identical manner to the air conditioner 1 according to the first embodiment, the heat accumulation operation can be performed in the state in which the compressor 11 is driven at such a rotation frequency which enables excellent operating efficiency. Moreover, in the air conditioner, since the heat accumulation operation is performed when the indoor temperature is equal to or greater than (the set temperature+$\alpha$° C.), in an identical manner to the air conditioner 1 according to the first embodiment, the surplus heat can be accumulated in the heat accumulation circuit 31 and the accumulated heat can be used during the defrosting operation.

When the defrosting operation is performed in the air conditioner, the control device 43 controls the heat accumulation circuit valve 68 and opens the heat accumulation flow path 64 in such a way that the water flows through the heat accumulation flow path 32. In the air conditioner, during the defrosting operation, in an identical manner to the air conditioner 1 according to the first embodiment, the outdoor heat exchanger 14 can be heated using the heat accumulated in the heat accumulating unit 67, so that defrosting of the outdoor heat exchanger 14 can be done using the heat accumulated in the heat accumulating unit 67. In the air conditioner, since the outdoor heat exchanger 14 is heated using the heat accumulated in the heat accumulating unit 67, in an identical manner to the air conditioner 1 according to the first embodiment, defrosting of the outdoor heat exchanger 14 can be appropriately done without excessively cooling the indoor heat exchanger 22.

In the air conditioner 1 according to the first embodiment, the refrigerant does not pass through the inside of the room. Hence, as compared to the air conditioner according to the second embodiment, it is possible to reduce the risk of leakage of the refrigerant into the room.

In the air conditioner according to the second embodiment, the heat accumulation circuit 63 uses the heat accumulation circuit valve 68 to ensure that the refrigerant either flows or does not flow through the heat accumulation flow path 64. Alternatively, an on-off valve can be further installed. During the cooling operation, or during the heating operation, or during the heat accumulation operation; the control device 43 controls the on-off valve to ensure that the refrigerant flows through the indoor heat exchanger 22. During the defrosting operation, the control device 43 controls the on-off valve to ensure that the water does not flow through the indoor heat exchanger 22. In the air conditioner, even when such an on-off valve is used, it becomes possible to cut down on power consumption, while holding down a decline in the comfort level in an identical manner to the air conditioner according to the second embodiment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

1 air conditioner
2 outdoor machine

3 indoor machine
5 refrigerant circuit
6 water circuit
11 compressor
12 four-way valve
14 outdoor heat exchanger
15 expansion valve
16 intermediate heat exchanger
21 pump
22 indoor heat exchanger
31 heat accumulation circuit
32 heat accumulation flow path
35 heat accumulating unit
36 heat accumulation circuit valve
43 control device
61 refrigerant circuit
62 indoor heat exchanger
63 heat accumulation circuit
67 heat accumulating unit
68 heat accumulation circuit valve

The invention claimed is:

1. An air conditioner comprising:

an outdoor machine that includes a compressor and an outdoor heat exchanger;

an indoor machine that includes an indoor heat exchanger and that heats inside of a room using heat supplied from the outdoor machine;

an indoor temperature sensor that detects temperature inside the room;

a heat accumulation circuit that includes a heat accumulating unit and that accumulates heat, which is generated in the outdoor machine, in the heat accumulating unit; and a control unit, wherein the control unit controls the compressor in such a way that detection value obtained by the indoor temperature sensor becomes equal to set temperature, and when the compressor operates at minimum rotation frequency and when detection value obtained by the indoor temperature sensor exceeds the set temperature, operates the heat accumulation circuit.

2. The air conditioner according to claim 1, wherein, when a defrosting operation is performed in which the outdoor heat exchanger is heated, the heat accumulation circuit heats a refrigerant that flows through the outdoor heat exchanger using heat of the heat accumulating unit and.

3. The air conditioner according to claim 2, wherein when remaining time period till scheduled start timing of the defrosting operation is shorter than a predetermined threshold time period, the control unit controls the compressor in such a way that rotation frequency of the compressor becomes higher than present rotation frequency, and the heat accumulation circuit heats the heat accumulating unit using heat of the refrigerant.

4. The air conditioner according to claim 1, wherein, when present rotation frequency of the compressor is lower than a rotation frequency threshold value, the heat accumulation circuit controls the compressor in such a way that rotation frequency of the compressor becomes equal to or higher than the rotation frequency threshold value, and heats the heat accumulating unit using heat of a refrigerant that flows through the outdoor heat exchanger.

5. The air conditioner according to claim 1, further comprising:

another circuit that circulates another refrigerant which is different than a refrigerant flowing through the outdoor heat exchanger; and an intermediate heat exchanger that heats the another refrigerant using heat of the refrigerant, wherein the indoor machine heats the inside of the room using heat of the another refrigerant, and the heat accumulation circuit heats the heat accumulating unit using heat of the another refrigerant.

6. The air conditioner according to claim 5, wherein, when a defrosting operation is performed in which the outdoor heat exchanger is heated, the heat accumulation circuit heats the another refrigerant using heat of the heat accumulating unit, and heats the refrigerant using heat of the another refrigerant.

* * * * *